US011158948B2

(12) United States Patent
Lee et al.

(10) Patent No.: US 11,158,948 B2
(45) Date of Patent: Oct. 26, 2021

(54) ANTENNA APPARATUS

(71) Applicant: Samsung Electro-Mechanics Co., Ltd., Suwon-si (KR)

(72) Inventors: Won Cheol Lee, Suwon-si (KR); Nam Ki Kim, Suwon-si (KR); Jae Min Keum, Suwon-si (KR); Jeong Ki Ryoo, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 8 days.

(21) Appl. No.: 16/672,888

(22) Filed: Nov. 4, 2019

(65) Prior Publication Data

US 2020/0303821 A1 Sep. 24, 2020

(30) Foreign Application Priority Data

Mar. 20, 2019 (KR) ..... 10-2019-0031892
Jun. 13, 2019 (KR) ..... 10-2019-0069810

(51) Int. Cl.
*H01Q 9/04* (2006.01)
*H01Q 5/335* (2015.01)
*H01Q 5/40* (2015.01)

(52) U.S. Cl.
CPC ..... *H01Q 9/045* (2013.01); *H01Q 5/335* (2015.01); *H01Q 5/40* (2015.01); *H01Q 9/0414* (2013.01)

(58) Field of Classification Search
CPC .... H01Q 9/0414; H01Q 9/045; H01Q 21/065; H01Q 1/38; H01Q 1/243; H01Q 1/2283; H01Q 9/0407; H01Q 21/28; H01Q 9/0435; H01Q 1/48; H01Q 21/24; H01Q 5/40; H01Q 5/378; H01Q 19/005; H01Q 9/0457;
(Continued)

(56) References Cited

U.S. PATENT DOCUMENTS 10,193,231 B2 1/2019 Wallace et al.
2003/0146872 A1* 8/2003 Kellerman ..... H01Q 5/385 343/700 MS
(Continued)

FOREIGN PATENT DOCUMENTS

JP 2015-216577 A 12/2015
KR 10-2009-0130922 A 12/2009

OTHER PUBLICATIONS

Anguera, Jaume et al., "Multifrequency Microstrip Patch Antenna Using Multiple Stacked Elements", *IEEE Microwave and Wireless Components Letters*, vol. 13, Issue 3, Mar. 2003 (pp. 123-124).
(Continued)

*Primary Examiner* — Linh V Nguyen
(74) *Attorney, Agent, or Firm* — NSIP Law

(57) ABSTRACT

An antenna apparatus includes a first patch antenna pattern comprising a through-hole, a second patch antenna pattern disposed above the first patch antenna pattern and spaced apart from the first patch antenna pattern, a first feed via electrically connected to the first patch antenna pattern, a second feed via penetrating through the through-hole of the first patch antenna pattern, and a feed pattern disposed between the first patch antenna pattern and the second patch antenna pattern, and having one end connected to the second feed via, and another end connected to the second patch antenna pattern at a point closer to an edge of the second patch antenna pattern than the second feed.

20 Claims, 11 Drawing Sheets

(58) Field of Classification Search
CPC ..... H01Q 1/521; H01Q 21/08; H01Q 19/24; H01Q 1/526; H01Q 25/00; H01Q 25/001; H01Q 5/35; H01Q 9/0464
USPC ..... 343/770, 700 MS, 841, 872, 846, 848
See application file for complete search history.

(56) References Cited

U.S. PATENT DOCUMENTS

| | | | | |
|---|---|---|---|---|
| 2006/0256016 | A1* | 11/2006 | Wu | H01Q 21/065 343/700 MS |
| 2008/0136734 | A1* | 6/2008 | Manholm | H01Q 9/0414 343/893 |
| 2013/0099982 | A1* | 4/2013 | Andrenko | H01Q 5/40 343/700 MS |
| 2014/0145883 | A1* | 5/2014 | Baks | H01Q 1/2283 343/700 MS |
| 2015/0333407 | A1 | 11/2015 | Yamagajo et al. | |
| 2016/0261039 | A1* | 9/2016 | Parsche | H01Q 9/0407 |
| 2018/0316098 | A1* | 11/2018 | Amadjikpe | H01Q 9/0457 |
| 2019/0020110 | A1* | 1/2019 | Paulotto | H01Q 19/005 |
| 2019/0165475 | A1* | 5/2019 | Shibata | H01Q 19/005 |
| 2019/0252800 | A1* | 8/2019 | Yetisir | H01Q 21/065 |
| 2020/0021019 | A1* | 1/2020 | Rajagopalan | H01Q 9/0414 |
| 2020/0106158 | A1* | 4/2020 | Gomez Angulo | G06F 1/1698 |
| 2020/0112081 | A1* | 4/2020 | Kim | H01L 23/5383 |
| 2021/0098894 | A1* | 4/2021 | Haviv | H01Q 1/243 |

OTHER PUBLICATIONS

Sharma, Devendra Kumar, et al. "Shared Aperture Dual Band Dual Polarization Microstrip Patch Antenna," *Microwave and Optical Technology Letters*, vol. 55, Issue 4, Apr. 2013 (pp. 917-922).

* cited by examiner

ANTENNA APPARATUS

CROSS-REFERENCE TO RELATED APPLICATIONS

This application claims the benefit under 35 USC 119(a) of Korean Patent Application Nos. 10-2019-0031892 filed on Mar. 20, 2019, and 10-2019-0069810 filed on Jun. 13, 2019, in the Korean Intellectual Property Office, the entire disclosures of which are incorporated herein by reference for all purposes.

BACKGROUND

1. Field

This application relates to an antenna apparatus.

2. Description of Related Art

Mobile communications data traffic is increasing rapidly every year. Active technological development is underway to support the transmission of such rapidly increased data in real time in wireless networks. For example, the contents of Internet of things (IoT) based data, augmented reality (AR), virtual reality (VR), live VR/AR combined with SNS, autonomous navigation, and applications such as Sync View (real-time video transmissions of users using ultra-small cameras) may require communications (for example, 5G communications or mmWave communications) supporting the transmission and reception of large amounts of data.

Recently, millimeter wave (mmWave) communications, including 5th generation (5G) communications, have been actively researched, and research into the standardization and commercialization of an antenna apparatus for effective for performing such communications is actively progressing.

Since RF signals in high frequency bands (for example, 24 GHz, 28 GHz, 36 GHz, 39 GHz, and 60 GHz) are easily absorbed and lost in the course of the transmission thereof, the quality of communications using such RF signals may be dramatically reduced. Therefore, antennas for communications in high frequency bands may require different approaches from those of conventional antenna technology, and a separate approach may necessitate additional special technologies, such as separate power amplifiers for providing a sufficient antenna gain, integrating an antenna and a radio-frequency integrated circuit (RFIC), and achieving a sufficient effective isotropic radiated power (EIRP).

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes a first patch antenna pattern including a through-hole; a second patch antenna pattern disposed above the first patch antenna pattern and spaced apart from the first patch antenna pattern; a first feed via electrically connected to the first patch antenna pattern; a second feed via penetrating through the through-hole of the first patch antenna pattern; and a feed pattern disposed between the first patch antenna pattern and the second patch antenna pattern, and having one end connected to the second feed via, and another end connected to the second patch antenna pattern at a point closer to an edge of the second patch antenna pattern than the second feed via.

The first feed via may be disposed farther from a center of the first patch antenna pattern than the second feed via.

An electrical connection point of the first patch antenna pattern may be biased more than an electrical connection point of the second patch antenna pattern from centers of the first and second patch antenna patterns in a horizontal direction.

The antenna apparatus may further include a coupling patch pattern disposed above the second patch antenna pattern and spaced apart from the second patch antenna pattern.

A spacing distance between the first patch antenna pattern and the second patch antenna pattern may be shorter than a spacing distance between the second patch antenna pattern and the coupling patch pattern.

The coupling patch pattern may include a slot.

The second patch antenna pattern may be smaller than the first patch antenna pattern and larger than the coupling patch pattern.

The second patch antenna pattern have a hole-free shape.

The antenna apparatus may further include a plurality of shielding vias electrically connected to the first patch antenna pattern and surrounding the second feed via.

The shielding vias may be offset from a center of the first patch antenna pattern in a first direction, and the antenna apparatus may further include a plurality of dummy vias electrically connected to the first patch antenna pattern and offset from the center of the first patch antenna pattern in a second direction different from the first direction in which the plurality of shielding vias are offset from the center of the first patch antenna pattern.

The antenna apparatus may further include a ground plane disposed below the first patch antenna pattern, and including two through-holes through which the first feed via and the second feed via penetrate, and the plurality of shielding vias and the plurality of dummy vias may be electrically connected to the ground plane.

The plurality of dummy vias may be disposed to be nearly symmetrical with respect to the plurality of shielding vias relative to the center of the first patch antenna pattern.

In another general aspect, an antenna apparatus includes a first patch antenna pattern including a through-hole; a second patch antenna pattern disposed above the first patch antenna pattern and spaced apart from the first patch antenna pattern; a first feed via electrically connected to the first patch antenna pattern; a second feed via penetrating through the through-hole of the first patch antenna pattern; a plurality of shielding vias electrically connected to the first patch antenna pattern, surrounding the second feed via, and offset from a center of the first patch antenna pattern in a first direction; and a plurality of dummy vias electrically connected to the first patch antenna pattern and offset from the center of the first patch antenna pattern in a second direction different from the first direction in which the plurality of shielding vias are offset from the center of the first patch antenna pattern.

The plurality of dummy vias may be disposed to be nearly symmetrical with respect to the plurality of shielding vias relative to the center of the first patch antenna pattern.

The antenna apparatus may further include a ground plane disposed below the first patch antenna pattern, and including two through-holes through which the first feed via and the second feed via penetrate, and the plurality of shielding vias and the plurality of dummy vias may be electrically connected to the ground plane.

The antenna apparatus may further include a coupling patch pattern including a slot and disposed above the second patch antenna pattern and spaced apart from the second patch antenna pattern.

In another general aspect, an antenna apparatus includes a first patch antenna pattern including a through-hole; a second patch antenna pattern disposed above the first patch antenna pattern and spaced apart from the first patch antenna pattern; a first feed via electrically connected to the first patch antenna pattern; and a second feed via penetrating through the through-hole of the first patch antenna pattern and electrically connected to the second patch antenna pattern, wherein a first connection point at which the first feed via is electrically connected to the first patch antenna pattern is farther from a center of the first patch antenna pattern in a first direction than the through-hole is from the center of the first patch antenna pattern in a second direction opposite to the first direction.

A second connection point at which the second feed via is electrically connected to the second patch antenna pattern may be closer to an edge of the second patch antenna pattern in the second direction than the first connection point is to an edge of the first patch antenna pattern in the first direction.

The antenna apparatus may further include a feed pattern disposed between the first patch antenna pattern and the second patch antenna pattern; and a third via disposed between the first patch antenna pattern and the second patch antenna pattern; wherein a first end of the feed pattern is connected to the second feed via, a second end of the feed pattern is connected to a first end of the third via, and a second end of the third via is connected to the second patch antenna pattern at the second connection point.

The antenna apparatus may further include a plurality of shielding vias electrically connected to the first patch antenna pattern and surrounding the second feed via; and a plurality of dummy vias electrically connected to the first patch antenna pattern, wherein each of the dummy vias is disposed a first distance from a center of the first patch antenna pattern in the first direction that is equal to a second distance a corresponding one of the shielding vias is disposed from the center of the first patch antenna pattern in the second direction.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
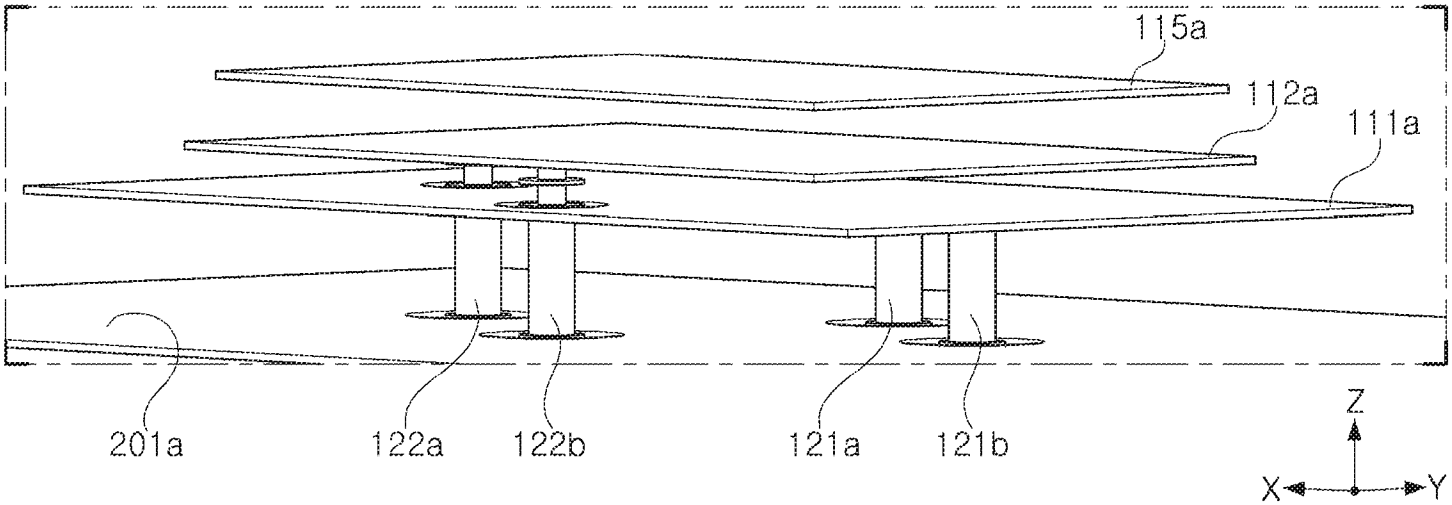
FIGS. 1A and 1B are a perspective view and a side view illustrating an example of a plurality of patch antenna patterns and a plurality of feed vias of an antenna apparatus.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

The features of the examples described herein may be combined in various ways as will be apparent after an understanding of the disclosure of this application. Further, although the examples described herein have a variety of configurations, other configurations are possible, as will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated by 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Figure 1B:
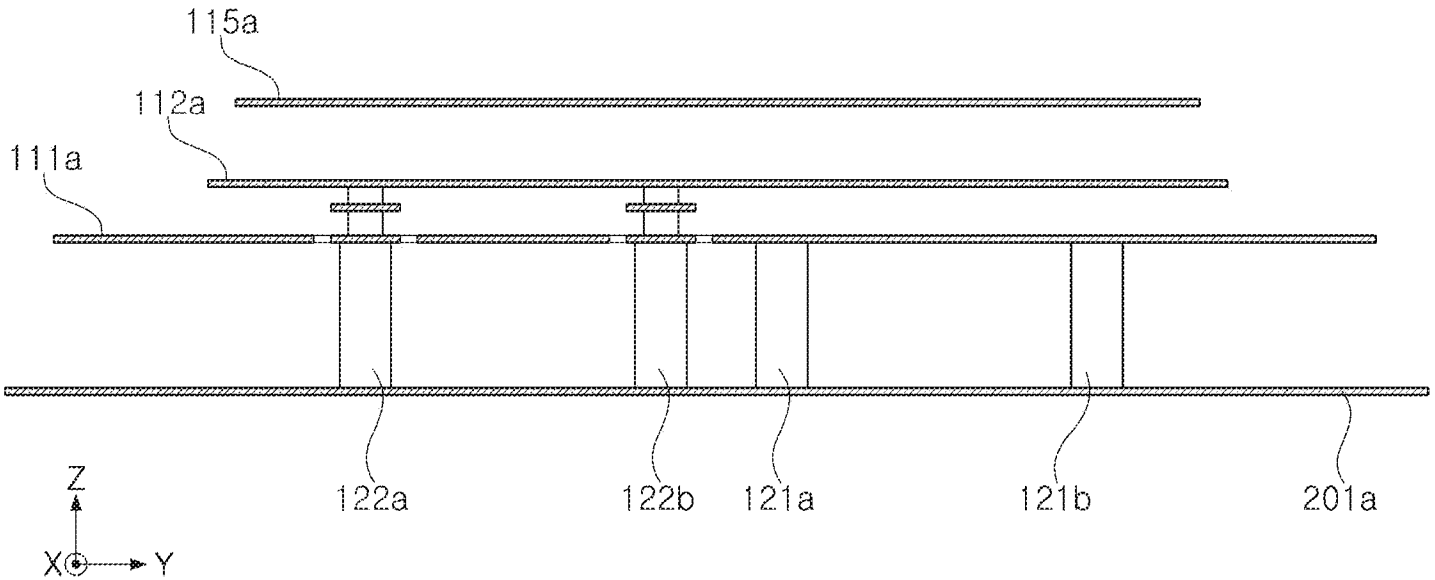

FIGS. 1A and 1B are a perspective view and a side view illustrating an example of a plurality of patch antenna patterns and a plurality of feed vias of an antenna apparatus.

Referring to FIGS. 1A and 1B, an antenna apparatus includes a first patch antenna pattern 111*a* and a second patch antenna pattern 112*a* to transmit and receive radio-frequency (RF) signals in a plurality of different frequency bands. The antenna apparatus further includes a coupling patch pattern 115*a* to increase a frequency bandwidth of the second patch antenna pattern 112*a*. The coupling patch pattern 115*a* may be omitted depending on bandwidth design conditions.

In addition, the antenna apparatus includes first feed vias 121*a* and 121*b*, second feed vias 122*a* and 122*b*, and a ground plane 201*a*.

The first patch antenna pattern 111*a* is electrically connected to one end of each of the first feed vias 121*a* and 121*b*. Accordingly, the first patch antenna pattern 111*a* receives two first RF signals in a first frequency band (for example, 28 GHz) from the first feed vias 121*a* and 121*b* and transmits the received first RF signals, or receives the first RF signals and outputs the received first RF signals to the first feed vias 121*a* and 121*b*.

The second patch antenna pattern 112*a* is electrically connected to one end of each of the second feed vias 122*a* and 122*b*. Accordingly, the second patch antenna pattern 112*a* receives two second RF signals in a second frequency band (for example, 39 GHz) from the second feed vias 122*a* and 122*b* and transmits the received second RF signals, or receives the second RF signals and outputs the received second RF signals to the second vias 122*a* and 122*b*.

The first and second patch antenna patterns 111*a* and 112*a* resonate in the first and second frequency bands to receive energy corresponding to the first and second RF signals from the first and second feed vias 121*a*, 121*b*, 122*a*, and 122*b*, and radiate the received energy as the first and second RF signals, or receive energy corresponding to the first and second RF signals and output the received energy to the first and second feed vias 121*a*, 121*b*, 122*a*, and 122*b* as the first RF signals and the second RF signals.

The first and second RF signals radiated by the first and second patch antenna patterns 111*a* and 112*a* are reflected by the ground plane 201*a*, causing radiation patterns of the first and second patch antenna patterns 111*a* and 112*a* to be concentrated in a specific direction (for example, a Z direction as illustrated in FIGS. 1A and 1B). Thus, gains of the first and second patch antenna patterns 111*a* and 112*a* are improved by the ground plane 201*a*.

Resonant frequencies of the first and second patch antenna patterns 111*a* and 112*a* depend on a combination of inductance and capacitance corresponding to the first and second patch antenna patterns 111*a* and 112*a* and a peripheral structure thereof.

A size of a top surface and/or a bottom surface of each of the first and second patch antenna patterns 111*a* and 112*a* has an effect on a resonant frequency. For example, the size of the top surface and/or the bottom surface of each of the first and second patch antenna patterns 111*a* and 112*a* depends on first and second wavelengths respectively corresponding to the first and second frequencies. When the first frequency (for example, 28 GHz as discussed above) is lower than the second frequency (for example, 39 GHz as discussed above), the first patch antenna pattern 111*a* is larger than the second patch antenna pattern 112*a*.

At least a portion of the first patch antenna pattern 111*a* and at least a portion of the second patch antenna pattern 112*a* overlap each other when viewed in a vertical direction (for example, the Z direction). This enables a size of the antenna apparatus in a horizontal direction (for example, an X direction and/or a Y direction) to be significantly decreased, thereby enabling the antenna apparatus to be easily miniaturized.

The first and second feed vias 121*a*, 121*b*, 122*a*, and 122*b* penetrate through respective through-holes in the ground plane 201*a*. Thus, one end of each of the first and second feed vias 121*a*, 121*b*, 122*a*, and 122*b* is disposed above the ground plane 201*a*, and the other end of each of the first and second feed vias 121*a*, 121*b*, 122*a*, and 122*b* is disposed below the ground plane 201*a*. The other end of each of the first and second feed vias 121*a*, 121*b*, 122*a*, and 122*b* is electrically connected to an integrated circuit (IC) (not shown in FIGS. 1A and 1B) to output the first and second RF signals to the IC or to receive the first and second RF signals from the IC. A degree of electromagnetic isolation between the first and second patch antenna patterns 111*a* and 112*a* and the IC is improved by the ground plane 201*a*.

The first feed vias 121*a* and 121*b* include a 1-1-th feed via 121*a* and a 1-2-th feed via 121*b* through which a 1-1-th RF signal and a 1-2-th RF signal having different phases respectively pass. The second feed vias 122*a* and 122*b* include a 2-1-th feed via 122*a* and a 2-2-th feed via 122*b* through which a 2-1-th RF signal and a 2-2-th RF signal having different phases respectively pass.

Thus, each of the first and second patch antenna patterns 111*a* and 112*a* receives two RF signals, which may be two carrier signals having different types of data encoded thereon. Therefore, a data transmission and reception rate of each of the first and second patch antenna patterns 111*a* and 112*a* is doubled by the transmission and reception of the two RF signals.

The 1-1-th RF signal and the 1-2-th RF signal have different phases (for example, a phase difference of 90 degrees or 180 degrees) to reduce mutual interference, and the 2-1-th RF signal and the 2-2-th RF signal have different phases (for example, a phase difference of 90 degrees or 180 degrees) to reduce mutual interference.

For example, the 1-1-th RF signal and the 2-1-th RF signal each generate an electromagnetic wave in which an electric field and a magnetic field are perpendicular to each other (for example, an electric field in the X direction and a magnetic field in the Y direction) and are perpendicular to a propagation direction (for example, the Z direction). Also, the 1-2-th RF signal and the 2-2-th RF signal each generate an electromagnetic wave in which an electric field and a magnetic field are perpendicular to each other (for example, an electric field in the Y direction and a magnetic field in the X direction) and are perpendicular to a propagation direction (for example, the Z direction). Thus, a polarization of the electromagnetic wave generated by the 1-1-th RF signal is opposite to a polarization of the electromagnetic wave generated by the 1-2-th RF signal. Also, a polarization of the electromagnetic wave generated by the 2-1-th RF signal is opposite to a polarization of the electromagnetic wave generated by the 2-2-th RF signal. To accomplish this, in the first and second patch antenna patterns 111*a* and 112*a*, surface currents corresponding to the 1-1-th RF signal and the 2-1-th RF signal flow perpendicularly to each other, and surface currents corresponding to the 1-2-th RF signal and the 2-2-th RF signal flow perpendicularly to each other.

Accordingly, the 1-1-th feed via 121*a* and the 2-1-th feed via 122*a* are connected to the first and second patch antenna patterns 111*a* and 112*a* near edges of the first and second patch antenna patterns 111*a* and 112*a* in one direction (for example, the Y direction), and the 1-2-th feed via 121*b* and the 2-2-th feed via 122*b* are connected to the first and second patch antenna patterns 111*a* and 112*a* near edges of the first and second patch antenna patterns 111*a* and 112*a* in another direction (for example, the X direction) perpendicular to the one direction. However, specific connection points may vary depending on a design of the antenna apparatus.

The shorter an electrical length from the first and second patch antenna patterns 111*a* and 112*a* to the IC, the less an energy loss of the first and second RF signals in the antenna apparatus. Since a height of the first and second patch antenna patterns 111*a* and 112*a* and the IC in the vertical direction (for example, the Z direction) is relatively short, the first and second feed vias 121*a*, 121*b*, 122*a*, and 122*b* enable the electrical distance between the first and second patch antenna patterns 111*a* and 112*a* and the IC to be easily decreased.

When at least a portion of the first patch antenna pattern 111*a* and at least a portion of the second patch antenna pattern 112*a* overlap each other when viewed in the Z direction, the second feed vias 122*a* and 122*b* may penetrate through the first patch antenna pattern 111*a* to enable the second feed vias 122*a* and 122*b* to be electrically connected to the second patch antenna pattern 112*a*.

Accordingly, a transmission energy loss of the first and second RF signals in the antenna apparatus may be reduced, and connection points of the first and second feed vias 121*a*, 121*b*, 122*a*, and 122*b* to the first and second patch antenna patterns 111*a* and 112*a* may be more freely selected.

The connection points of the first and second feed vias 121*a*, 121*b*, 122*a*, and 122*b* affect impedances of the patch antenna patterns 111*a* and 112*a*. The more closely the impedances of the patch antenna patterns 111*a* and 112*a* are matched to a transmission-line impedance (for example, 50 ohms) of transmission lines delivering the 1-1-th, 1-2-th, 2-1-th, and 2-2-th RF signals to the first and second feed vias 121*a*, 121*b*, 122*a*, and 122*b*, the more reflection loss in the transmission lines is reduced. Therefore, when a degree of freedom of selection of the connection points of the first and second feed vias 121*a*, 121*b*, 122*a*, and 122*b* is high, the gain of the first and second patch antenna patterns 111*a* and 112*a* may be more easily improved.

However, when the second feed vias 122*a* and 122*b* penetrate through the first patch antenna pattern 111*a*, the second feed vias 122*a* and 122*b* are affected by the first RF signals radiated from the first patch antenna pattern 111*a*. Accordingly, a degree of electromagnetic isolation between the first and second RF signals is reduced, causing the gain of each of the first and second patch antenna patterns 111*a* and 112*a* to be reduced.

Figure 2A:
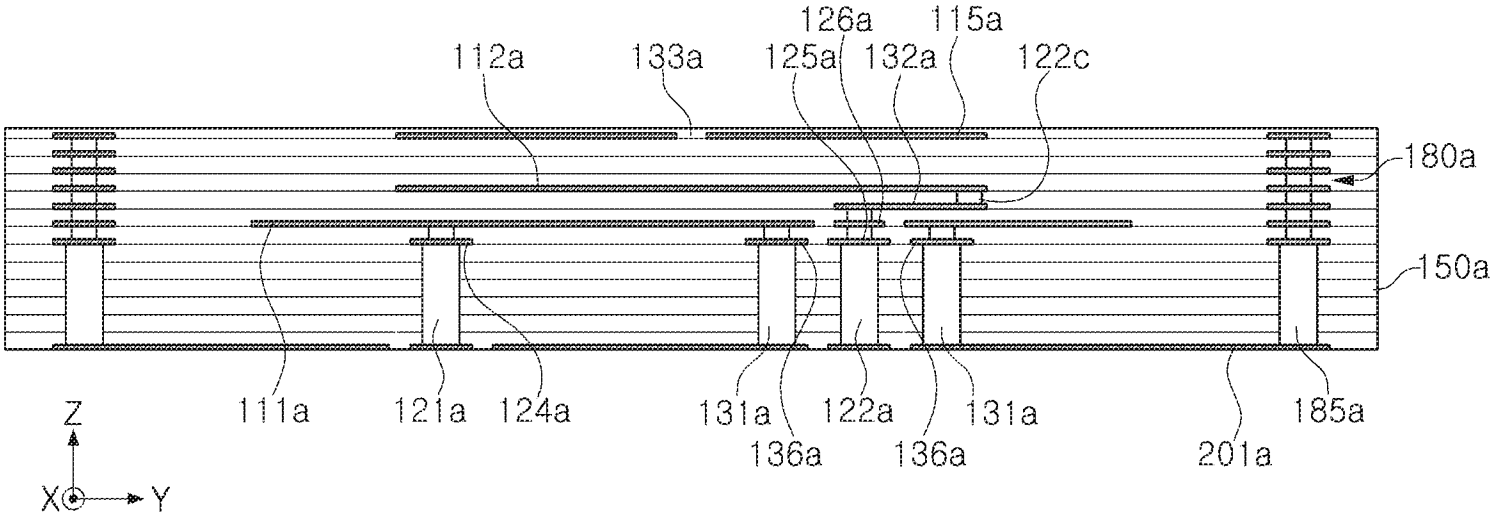
FIGS. 2A and 2B are a side view and a top view, with the top view including a partial perspective view, illustrating a modified example of the antenna apparatus of FIGS. 1A and 1B further including shielding vias, feed patterns, and a slot.
Figure 2B:
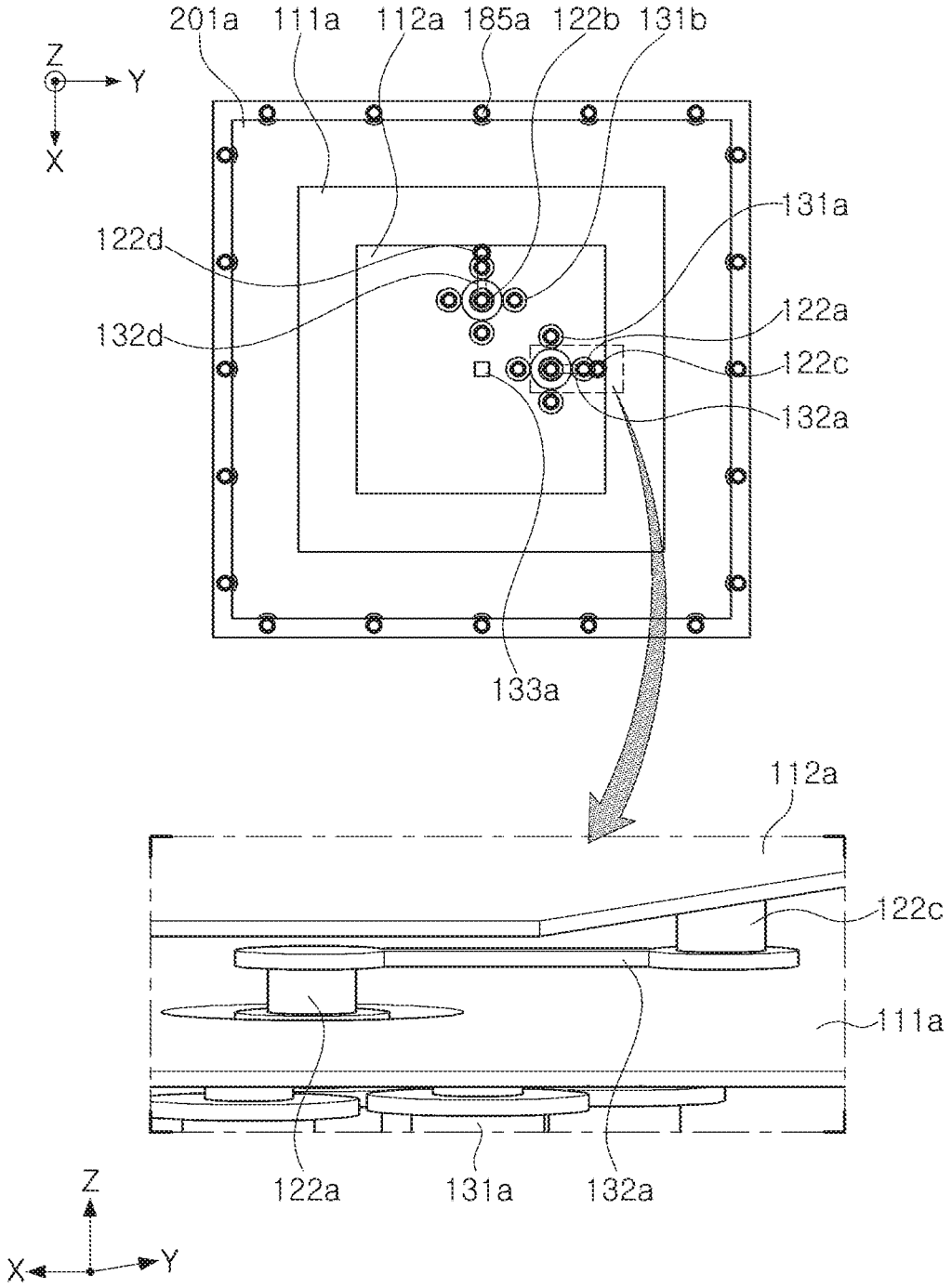

FIGS. 2A and 2B are a side and a top view, with the top view including a partial perspective view, illustrating a modified example of the antenna apparatus of FIGS. 1A and 1B further including shielding vias, feed patterns, and a slot.

Referring to FIGS. 2A and 2B, a modified example of the antenna apparatus further includes a plurality of shielding vias 131*a* surrounding the second feed via 122*a*, and a plurality of shielding vias 131*b* surrounding the second feed via 122*b*.

The plurality of shielding vias 131*a* and 131*b* electrically connect the first patch antenna pattern 111*a* and the ground plane 201*a* to each other. Accordingly, the first RF signals radiated from the first patch antenna pattern 111*a* toward the second feed vias 122*a* and 122*b* are reflected by the plurality of shielding vias 131*a* and 131*b*. Therefore, a degree of electromagnetic isolation between the first and the second RF signals is improved, causing a gain of each of the first and second patch antenna patterns 111*a* and 112*a* to be improved.

A number and a width of the plurality of shielding vias 131*a* and 131*b* are not limited. When the spaces between the plurality of shielding vias 131*a* and 131*b* are shorter than a specific length (for example, a length dependent on a first wavelength of the first RF signals, the first RF signals substantially cannot pass through the spaces between the plurality of shielding vias 131*a* and 131*b*. Accordingly, the degree of electromagnetic isolation between the first and second RF signals is further improved.

Referring to FIGS. 2A and 2B, the antenna device further includes feed patterns 132*a* and 132*b*.

The feed pattern 132*a* is disposed between the first and second patch antenna patterns 111*a* and 112*a*, and has one end electrically connected to the second feed via 122*a*, and another end electrically connected to the second patch antenna pattern 112*a* at a point closer to one edge of the second patch antenna pattern 112*a* than the second feed via 122*a*. Also, the feed pattern 132*b* is disposed between the first and second patch antenna patterns 111*a* and 112*a*, and has one end electrically connected to the second feed via 122*b*, and another end electrically connected to the second patch antenna pattern 112*a* at a point closer to another edge of the second patch antenna pattern 112*a* than the second feed via 122*b*.

For example, a 2-3-th feed via 122*c* electrically connects the feed pattern 132*a* and the second patch antenna pattern 112*a* to each other, and a 2-4-th feed via 122*d* connects the feed pattern 132*b* and the second patch antenna pattern 112*a* to each other. The feed pattern 132*a* may include the 2-3-th feed via 122*c*, or may be connected to the 2-3-th feed via 122*c*, and the feed pattern 132*b* may include the 2-4-th feed via 122*d*, or may be connected to the 2-4-th feed via 122*d*.

Since the through-holes of the first patch antenna pattern 111*a* and the plurality of shielding vias 131*a* and 131*b* act as obstacles to surface currents corresponding to the first RF signals, a negative influence of the first RF signals on the second feed vias 122*a* and 122*b* is reduced.

The closer the connection points of the second feed vias 122*a* and 122*b* are to the edge of the second patch antenna pattern 112*a*, the more advantageous for transmission-line impedance matching.

When first optimal positions of the through-holes of the first patch antenna pattern 111*a* and the shielding vias 131*a* and 131*b* do not match second optimal positions at which the second feed vias 122*a* and 122*b* are connected to the second patch pattern 112*a*, the feed patterns 132*a* and 132*b* enable both the first and second optimal positions to be implemented.

Accordingly, the gain of each of the first and second patch antenna patterns 111*a* and 112*a* is improved.

In addition, the through-hole of the first patch antenna pattern 111*a* and the shielding vias 131*a* and 131*b* act as obstacles to the surface currents corresponding to the first RF signals. Therefore, the longer the electrical distances between the first feed vias 121*a* and 121*b* to which the first RF signals are transmitted and the shielding vias 131*a* and 131*b*, the less a negative influence on the first RF signals.

Due to the feed pattern 132*a*, a spacing distance between the first and second feed vias 121*a* and 122*a* may be easily increased, and due to the feed pattern 132*b*, a spacing distance between the first and second feed vias 121*b* and 122*b* may be easily increased.

For example, the first feed vias 121*a* and 121*b* may be biased more in a direction from a center to an edge of the first patch pattern 111*a* than the second feed vias 122*a* and 122*b* to be electrically connected to the first patch antenna pattern 111*a*.

For example, the first feed vias 121*a* and 121*b* may be biased more in an edge direction than the electrical connection points of the feed patterns 132*a* and 132*b* to the second patch antenna pattern 112*a* to be electrically connected to the first patch antenna pattern 111*a*.

Accordingly, a negative influence of the through holes and the plurality of shielding vias 131*a* and 131*b* on the first RF signals is reduced in the first patch antenna pattern 111*a*. Therefore, the gain of the first patch antenna pattern 111*a* is further improved.

Referring to FIGS. 2A and 2B, a coupling patch pattern 115*a* has a slot 133*a*. Although the coupling patch pattern 115*a* has been omitted in FIG. 2B for clarity of illustration, the slot 133*a* is shown in FIG. 2B to show its position relative to the other elements.

The coupling patch pattern 115*a* provides additional capacitance and additional inductance so that the second patch antenna pattern 112*a* has an extrinsic resonant frequency, and thus increases a bandwidth of the second patch antenna pattern 112*a*. In this case, the extrinsic resonant frequency is determined based on an area of the coupling patch pattern 115*a* and a spacing distance between the coupling patch pattern 115*a* and the second patch antenna pattern 112*a*.

The extrinsic resonant frequency is lower than an intrinsic resonant frequency of the second patch antenna pattern 112. Although FIG. 2A shows that the coupling patch pattern 115*a* is slightly smaller than the second patch antenna pattern 112, it may be the same size as or larger than the second patch antenna pattern 112*a* depending on the desired extrinsic resonant frequency. The intrinsic resonant frequency is determined on intrinsic parameters (for example, a shape, a size, a height, and a dielectric constant of an insulating layer) of the patch antenna pattern.

The coupling patch pattern 115*a* is also electromagnetically coupled to the first patch antenna pattern 111*a*. As a result, the degree of electromagnetic isolation between the first and second RF signals is reduced.

Accordingly, the coupling patch pattern 115*a* has the slot 133*a* to allow a surface current in the coupling patch pattern 115*a* to flow while bypassing the slot 133*a*. For example, the electrical distance in terms of the surface current is increased by the slot 133*a* of the coupling patch pattern 115*a*. Accordingly, the coupling patch pattern 115*a* having the slot 133*a* may be smaller than the coupling patch pattern 115*a* without the slot 133*a*, while still lowering the extrinsic resonant frequency. In addition, the degree of electromagnetic isolation between the first and second RF signals is increased.

The second patch antenna pattern 112*a* is smaller than the first patch antenna pattern 111*a* and larger than the coupling patch pattern 115*a*. This causes the electromagnetic coupling of the coupling patch pattern 115*a* to be further concentrated on the second patch antenna pattern 112*a*, thereby increasing the degree of electromagnetic isolation between the first and second RF signals, In addition, the second patch antenna pattern 112*a* has a shape having no hole (for example, a through-hole, a slot, or any other hole). This causes the electromagnetic coupling of the coupling patch pattern 115*a* to be further concentrated on the second patch antenna pattern 112*a*, thereby increasing the degree of electromagnetic isolation between the first and second RF signals.

A spacing distance between the first and second patch antenna patterns 111*a* and 112*a* is shorter than a spacing distance between the second patch antenna pattern 112*a* and the coupling patch pattern 115*a*.

Since the spacing distance between the first and second patch antenna patterns 111*a* and 112*a* is reduced, the feed patterns 132*a* and 132*b* are further electromagnetically isolated from the outside of the first and second patch antennas 111*a* and 112*a*, and the electromagnetic coupling of the coupling patch pattern 115*a* is further concentrated on the second patch antenna pattern 112*a*. As a result, a gain and a bandwidth of the second patch antenna pattern 112*a* are further improved.

Referring to FIGS. 2A and 2B, the antenna apparatus further includes peripheral shielding members 180*a* surrounding the first and second patch antenna patterns 111*a* and 112*a*. The peripheral shielding members 180*a* are electrically connected to the ground plane 201*a* through peripheral vias 185*a*. The peripheral shielding members 180*a* improve a degree of electromagnetic isolation between the antenna apparatus in FIGS. 2A and 2B and an adjacent antenna apparatus. In the example illustrated in FIGS. 2A and 2B, the peripheral shielding members 180*a* each include a combination of horizontal patterns and a vertical vias, but are not limited thereto. The peripheral shielding members 180*a* and the peripheral vias 185*a* may be omitted depending on a design of the antenna apparatus.

Referring to FIGS. 2A and 2B, the first feed via 121*a* includes a support pattern 124*a* having a width greater than a width of the first feed via 121*a*, the second feed via 122*a* includes similar support patterns 125*a* and 126*a*, and each of the shielding vias 131*a* includes a similar support pattern 136*a*. Although not illustrated in FIGS. 2A and 2B, the first feed via 121*b*, the second feed via 122*b*, and the shielding vias 136*b* include similar support patterns. However, the support patterns 124*a*, 125*a*, 126*a*, and 136*a* and the similar support patterns of the first feed via 121*b*, the second feed via 122*b*, and the shielding vias 136*b* may be omitted depending on a design of the antenna apparatus.

A dielectric layer 150*a* fills in the spaces between the various elements between the ground plane 201*a* and the coupling patch pattern 115*a*.

Figure 3A:
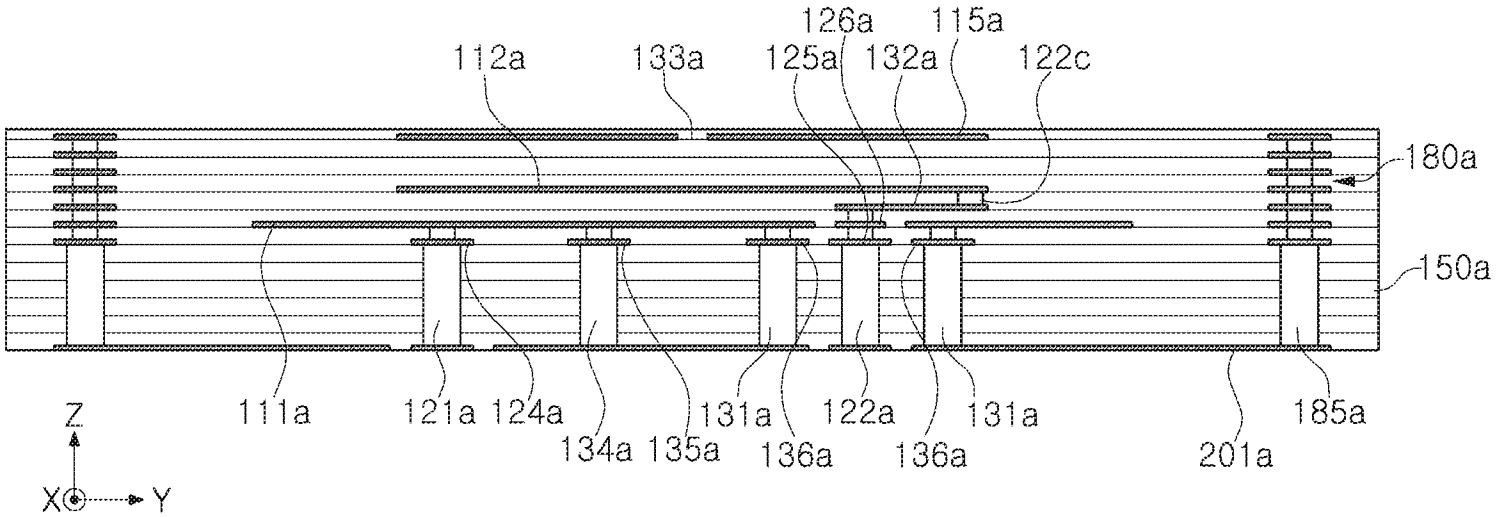
FIGS. 3A and 3B are a side view and a top view illustrating a modified example of the antenna apparatus of FIGS. 2A and 2B further including dummy vias.
Figure 3B:
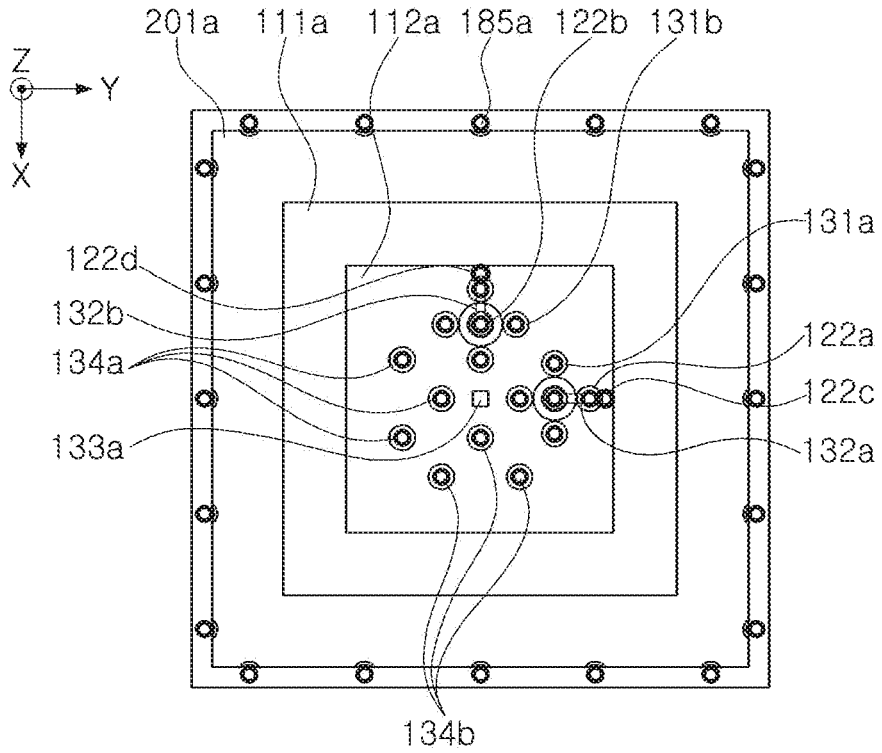

FIGS. 3A and 3B are a side view and a top view illustrating a modified example of the antenna apparatus of FIGS. 2A and 2B further including dummy vias.

Referring to FIGS. 3A and 3B, a modified example of the antenna apparatus of FIGS. 2A and 2B further includes a plurality of dummy vias 134*a* and 134*b*.

The plurality of dummy vias 134*a* are offset from a center of the first patch antenna pattern 111*a* in a direction opposite to a direction in which the plurality of shielding vias 131*a* are offset from the center of the first patch antenna pattern 111*a*. Also, the plurality of dummy vias 134*b* are offset from the center of the first patch antenna pattern 111*a* in a direction opposite to a direction in which the plurality of shielding vias 131*b* are offset from the center of the first patch antenna pattern 111*a*.

Each of the dummy vias 134*a* includes a support pattern 135*a* having a width greater than a width of the first dummy via 134*a*. Although not illustrated in FIGS. 3A and 3B, each of the dummy vias 134*b* includes a similar support pattern. However, the support patterns 135*a* and the similar support patterns of the dummy vias 134*b* may be omitted depending on a design of the antenna apparatus.

The plurality of dummy vias 134*a* and 134*b* electrically connect the first patch antenna pattern 111*a* and the ground plane 201*a* to each other.

Accordingly, relative to the center of the first patch antenna pattern 111*a*, the plurality of shielding vias 131*a* and the plurality of dummy vias 134*a* are arranged to be nearly symmetrical to each other overall, and the plurality of shielding vias 131*b* and the plurality of dummy vias 134*b* are arranged to be nearly symmetrical to each other overall.

Although a connection point of the first feed via 121*a* receiving the 1-1-th RF signal and a connection point of the second feed via 121*b* receiving the 1-2-th RF signal are different from each other in the first patch antenna pattern 111*a*, electrical characteristics of a surface current generated by the 1-1-th RF signal and electrical characteristics of a surface current generated by the 1-2-th RF signal are similar to each other in the first patch antenna pattern 111*a* because the plurality of vias electrically connected to the first patch antenna pattern 111*a* are nearly symmetrically arranged to each other. The higher the similarity of the electrical characteristics of the surface current generated by the 1-1-th RF signal and the electrical characteristics of the surface current generated by the 1-2-th RF signal, the lower the mutual interference between the 1-1-th RF signal and the 1-2-th RF signal.

Accordingly, the plurality of dummy vias 134*a* and 134*b* increase the overall symmetry of the arrangement of the plurality of vias electrically connected to the first patch antenna pattern 111*a*, thereby reducing interference between the 1-1-th RF signal and the 1-2-th RF signal and increasing an overall gain of the first patch antenna pattern 111*a*.

The plurality of dummy vias 134*a* are disposed to be symmetrical to the plurality of shielding vias 131*a* relative to the center of the first patch antenna pattern 111*a*, and the plurality of dummy vias 134*b* are disposed to be symmetrical to the plurality of shielding vias 131*b* relative to the center of the first patch antenna pattern 111*a*. Accordingly, the plurality of dummy vias 134*a* and 134*b* further increase the overall symmetry of the arrangement of the plurality of vias electrically connected to the first patch antenna pattern 111*a*, thereby reducing the interference between the 1-1-th RF signal and the 1-2-th RF increasing the overall gain of the first patch antenna pattern 111*a*.

Figure 4A:
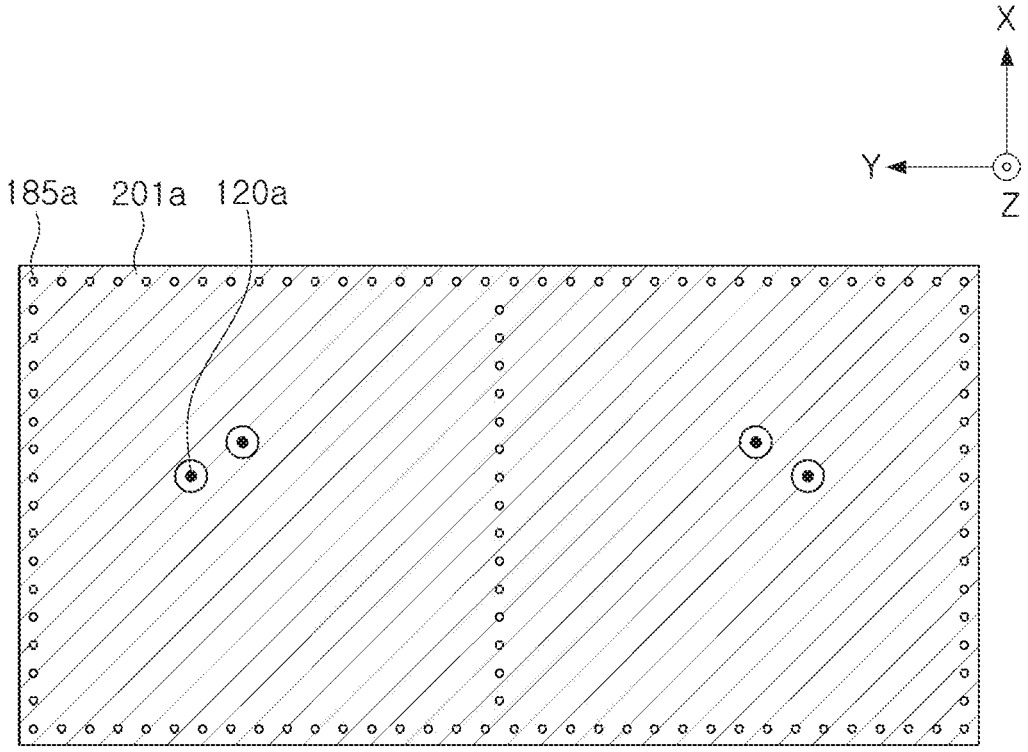
FIG. 4A is a top view illustrating an example of a ground plane of an antenna apparatus.
Figure 4B:
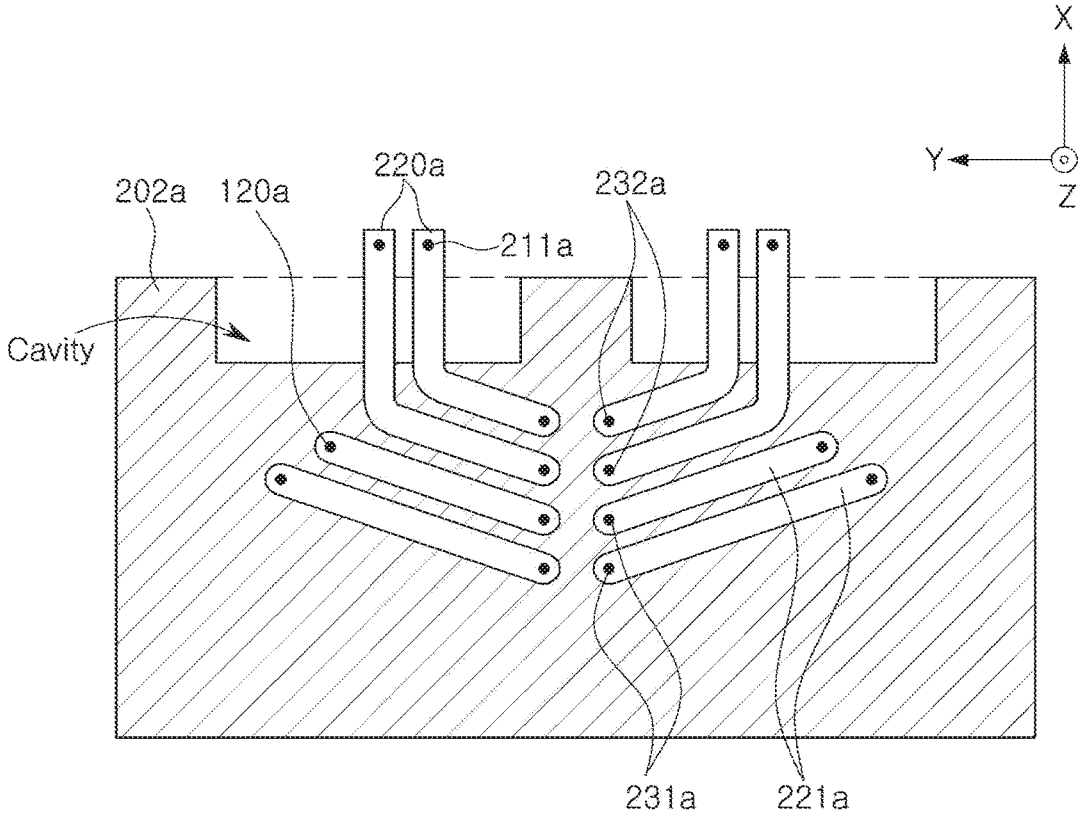
FIG. 4B is a top view illustrating an example of feed lines and a wiring ground plane below the ground plane of FIG. 4A.
Figure 4C:
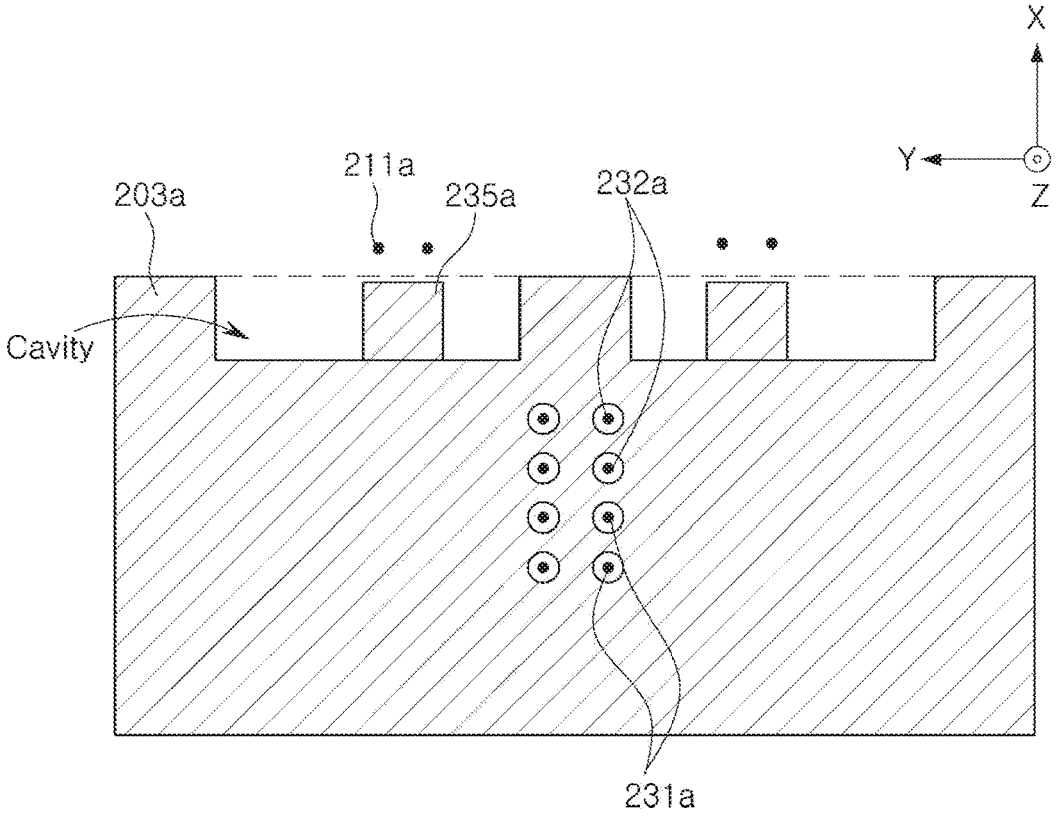
FIG. 4C is a top view illustrating an example of wiring vias and a second ground plane below the wiring ground plane of FIG. 4B.
Figure 4D:
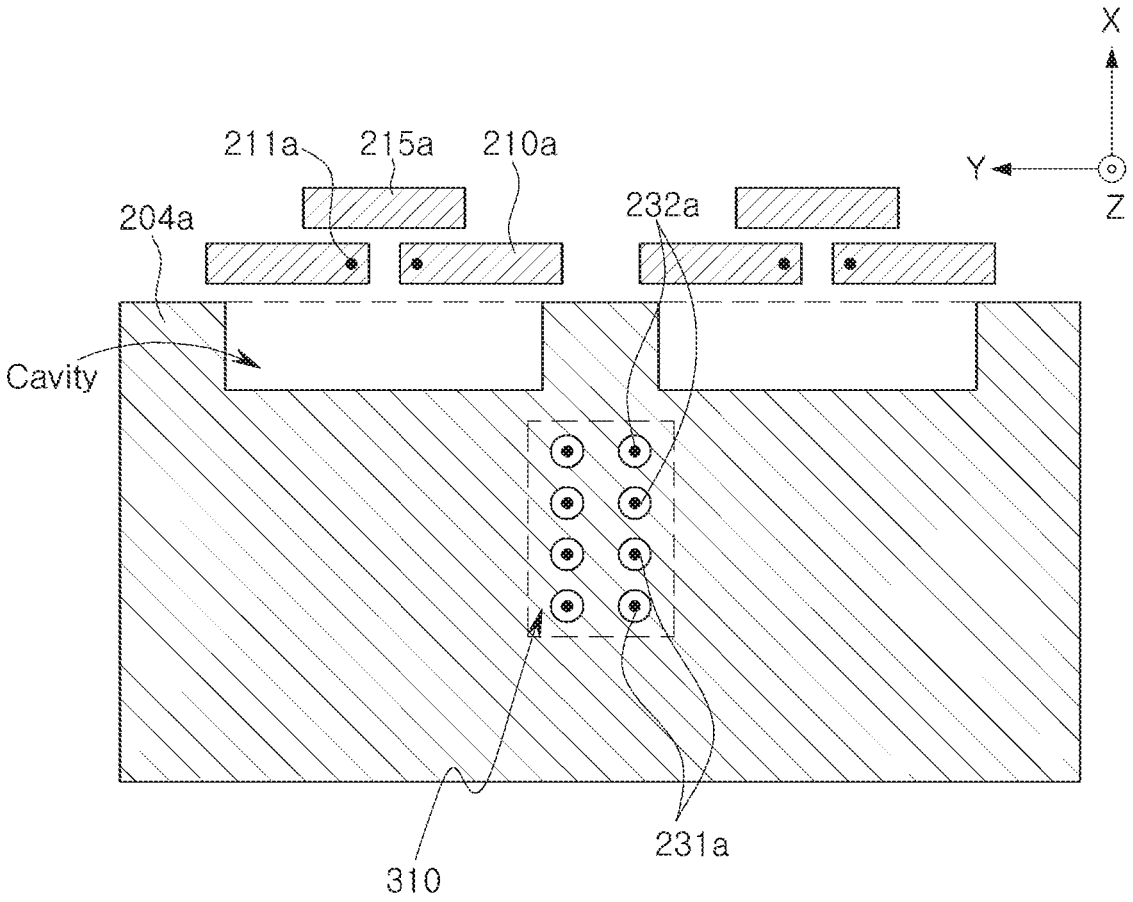
FIG. 4D is a top view illustrating an example of wiring vias, an IC placement region, end-fire antennas, and an IC ground plane below the second ground plane of FIG. 4C.

FIG. 4A is a top view illustrating an example of a ground plane of an antenna apparatus. FIG. 4B is a top view illustrating an example of feed lines and a wiring ground plane below the ground plane of FIG. 4A. FIG. 4C is a top view illustrating an example of wiring vias and a second ground plane below the wiring ground plane of FIG. 4B. FIG. 4D is a top view illustrating an example of wiring vias, an IC placement region, end-fire antennas, and an IC ground plane below the second ground plane of FIG. 4C.

Referring to FIGS. 4A to 4D, feed vias 120*a* correspond to the first and second feed vias 121*a*, 121*b*, 122*a*, and 122*b* described above. A plurality of antenna apparatuses may be arranged in a horizontal direction (for example, in either one or both of an X direction and a Y direction).

Referring to FIG. 4A, a ground plane 201*a* has through-holes through which the feed vias 120*a* pass, and provides electromagnetic shielding between patch antenna patterns, such as the first and second patch antenna patterns 111*a* and 112*a* shown in FIGS. 1A to 3B, and feed lines of the antenna apparatus. The peripheral vias 185*a* extend above the ground plane 201*a* in the Z direction as shown, for example, in FIGS. 2B and 3B.

Referring to FIG. 4B, a wiring ground plane 202*a* shields at least a portion of end-fire antenna feed lines 220*a* and feed lines 221*a*. One end of each of the end-fire antenna feed lines 220*a* is electrically connected to a corresponding one of second wiring vias 232*a*, and the other end of each of the end-fire antenna feed lines 220*a* is electrically connected to a corresponding one of end-fire antenna feed vias 211*a*. One end of each of the feed lines 221*a* is electrically connected to a corresponding one of first wiring vias 231*a*, and the other end of each of the feed lines 221*a* is connected to a corresponding one of the vias 120*a*. The wiring ground plane 202*a* provides electromagnetic shielding between the end-fire antenna feed lines 220*a* and the feed lines 221*a*.

Referring to FIG. 4C, a second ground plane 203*a* has through-holes through which the first wiring vias 231*a* and the second wiring vias 232*a* pass, and includes coupling ground patterns 235*a*. The second ground plane 203*a* provides electromagnetic shielding between the end-fire antenna feed lines 220*a* and the feed lines 221*a*, and the IC.

Referring to FIG. 4D, an IC ground plane 204*a* has through-holes through which the first wiring vias 231*a* and the second wiring vias 232*a* pass. As indicated by the dashed-line box in FIG. 4D, an IC 310 is disposed below the IC ground plane 204*a*, and is electrically connected to the first wiring vias 231*a* and the second wiring vias 232*a*. End-fire antenna patterns 210*a* and director patterns 215*a* are disposed at substantially the same height as the IC ground plane 204*a* to form end-fire antennas.

The IC ground plane 204*a* may include circuit patterns and ground patterns to connect the IC 310 to one or more passive components. Depending on a design of the antenna apparatus, the IC ground plane 204*a* may include circuit patterns and ground patterns to supply power and signals to the IC 310 and the one or more passive components. Thus, the IC ground plane 204*a* may be electrically connected to the IC 310 and the one or more passive components.

The wiring ground plane 202*a*, the second ground plane 203*a*, and the IC ground plane 204*a* have a recessed shape to provide cavities in their edges. This enables the end-fire antenna patterns 210*a* to be disposed to be closer to the IC ground plane 204*a*.

Vertical relationships and shapes of the wiring ground plane 202*a*, the second ground plane 203*a*, and the IC ground plane 204*a* may vary depending on a design of the antenna apparatus.

Figure 5A:
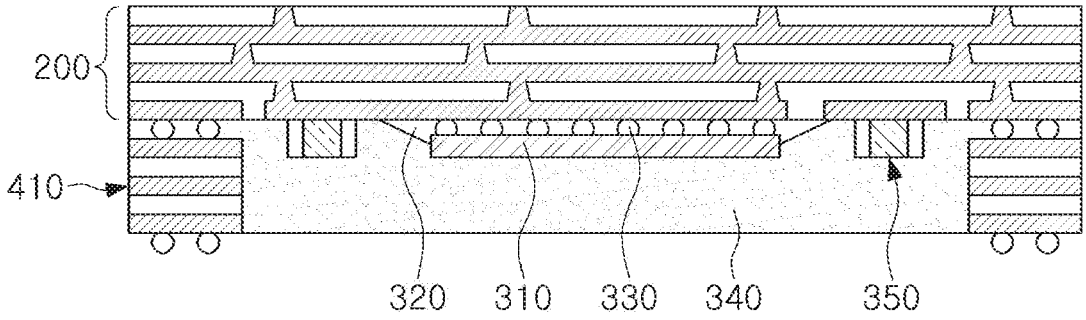
FIGS. 5A and 5B are side views illustrating the structures illustrated in FIGS. 4A to 4D and examples of a structure on a bottom surface thereof.
Figure 5B:
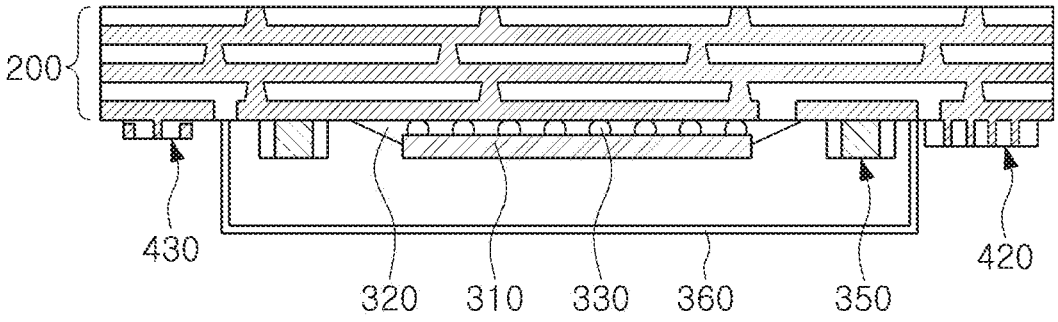

FIGS. 5A and 5B are side views illustrating the structures illustrated in FIGS. 4A to 4D and examples of a structure on a bottom surface thereof.

Referring to FIG. 5A, an example of an antenna apparatus includes a connection member 200, an IC 310, an adhesive member 320, an electrical connection structure 330, an encapsulant 340, a passive component 350, and a core member 410.

The connection member 200 has a structure in which a plurality of metal layers having patterns and a plurality of insulating layers are laminated, like in a printed circuit board (PCB). The connection member 200 represents the structures illustrated in FIGS. 4A to 4D.

The IC 310 is the IC described above in connection with FIG. 4D, and is mounted on a bottom surface of the connection member 200. The IC 310 is electrically connected to wiring vias of the connection member 200, for example, the first wiring vias 231*a* and the second wiring vias 232*a* in FIG. 4D, or circuit patterns of the connection member 200, to transmit and receive RF signals, and is electrically connected to one or more ground planes or ground patterns of the connection member 200 to receive a ground. For example, the IC 310 may perform at least some of frequency conversion, amplification, filtering, phase control, and power generation to generate an RF signal from a baseband or intermediate frequency (IF) signal, and to generate a baseband or IF signal from an RF signal.

The adhesive member 320 bonds the IC 310 and the connection member 200 to each other.

The electrical connection structure 330 electrically connects the IC 310 and the connection member 200 to each other. For example, the electrical connection structure 330 may have a structure such as solder balls, pins, lands, and pads. The electrical connection structure 330 has a melting point lower than a melting point of the wiring and the ground plane of the connection member 200, enabling the IC 310 and the connection member 200 to be electrically connected to each other using a predetermined joining process making use of the lower melting point of the electric connection structure 330.

The encapsulant 340 encapsulates the IC 310, and improves the heat radiation performance and the impact protection performance of the IC 310. For example, the encapsulant 340 may be a photoimageable encapsulant (PIE), Ajinomoto Build-up Film (ABF), or an epoxy molding compound (EMC).

The passive component 350 is mounted on a bottom surface of the connection member 200, and is electrically connected to either one or both of the circuit patterns and the ground planes or patterns of the connection member 200 through an electrical connection structure (not shown). For example, the passive component 350 may be a capacitor (for example, a multilayer ceramic capacitor (MLCC)), an inductor, or a chip resistor. The encapsulant 340 also encapsulates the passive component 350.

The core member 410 is disposed below the connection member 200, and is electrically connected to the connection member 200 to receive an IF signal or a baseband signal from an external component and transmit the IF signal or the baseband signal to the IC 310, or receive an IF signal or a baseband signal from the IC 310 and transmit the IF signal or the baseband signal to an external component. Frequencies of the RF signals (for example, 24 GHz, 28 GHz, 36 GHz, 39 GHz, or 60 GHz) are higher than a frequency of the IF signal (for example, 2 GHz, 5 GHz, or 10 GHz).

For example, the core member 410 may transmit an IF signal or a baseband signal to the IC 310, or may receive the IF signal or the baseband signal from the IC 310 through circuit patterns and ground patterns of an IC ground plane of the connection member 200, like the IC ground plane 204*a* in FIG. 4D. A first ground layer of the connection member 200 is disposed between the IC ground plane and the circuit patterns, enabling the IF signal or the baseband signal and the RF signal to be electrically isolated in the antenna apparatus.

Referring to FIG. 5B, another example of an antenna apparatus omits the core member 410 of FIG. 5A but includes a shielding member 360, a connector 420, and an end-fire chip antenna 430.

The shielding member 360 is disposed below the connection member 200 to shield the IC 310 together with the passive components 350 and a portion of the connection member 200. For example, the shielding member 360 may be disposed to conformally shield the IC 310 and the passive components 350 together, or compartmentally shield the IC 310 and the passive components 350 individually. For example, the shielding member 360 may have a hexahedral shape with one open side, and may form a hexahedral receiving space through bonding to the connection member 200. The shielding member 360 may be made of a material having a high conductivity such as copper to have a shallow skin depth, and is electrically connected to a ground plane of the connection member 200. Accordingly, the shielding member 360 reduces electromagnetic noise applied to the IC 310 and the passive components 350.

The connector 420 is a connector for a cable (for example, a coaxial cable or a flexible PCB), is electrically connected to the IC ground plane of the connection member 200, and performs a function similar to that of the core member 410 in FIG. 5A. For example, the connector 420 may receive an IF signal or a baseband signal and power from the cable, or may output an IF signal or a baseband signal and power to the cable.

The end-fire chip antenna 430 transmits or receives an RF signal to assist the antenna apparatus. For example, the end-fire chip antenna 430 includes a dielectric block having a dielectric constant greater than a dielectric constant of insulating layers of the connection member 200, and two electrodes disposed on opposite surfaces of the dielectric block. One of the plurality of electrodes is electrically connected to the circuit patterns of the connection member 200, and another one of the electrodes is electrically connected to the ground plane or patterns of the connection member 200.

Figure 6A:
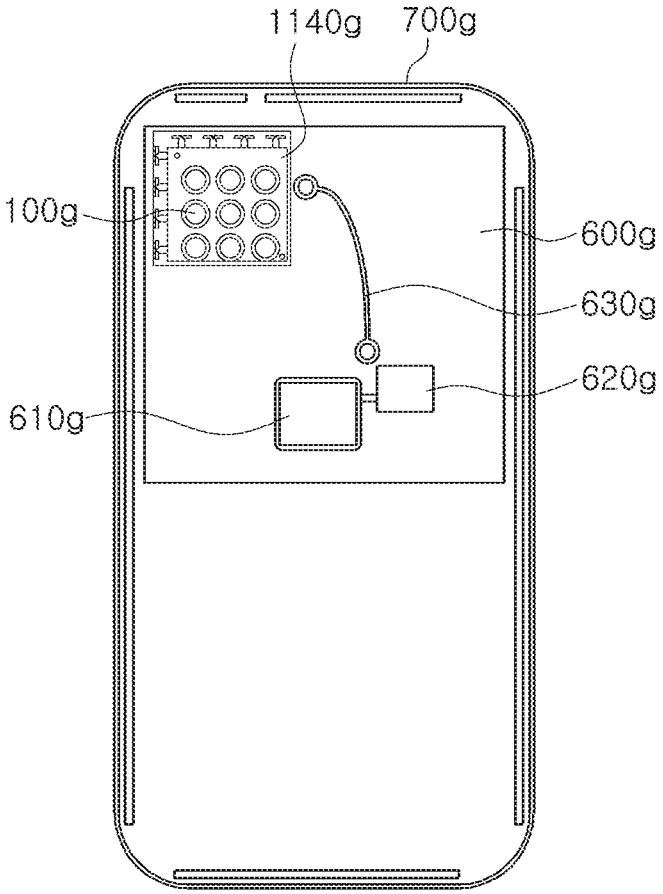
FIGS. 6A and 6B are top views illustrating examples of a placement of an antenna apparatus in an electronic device.
Figure 6B:
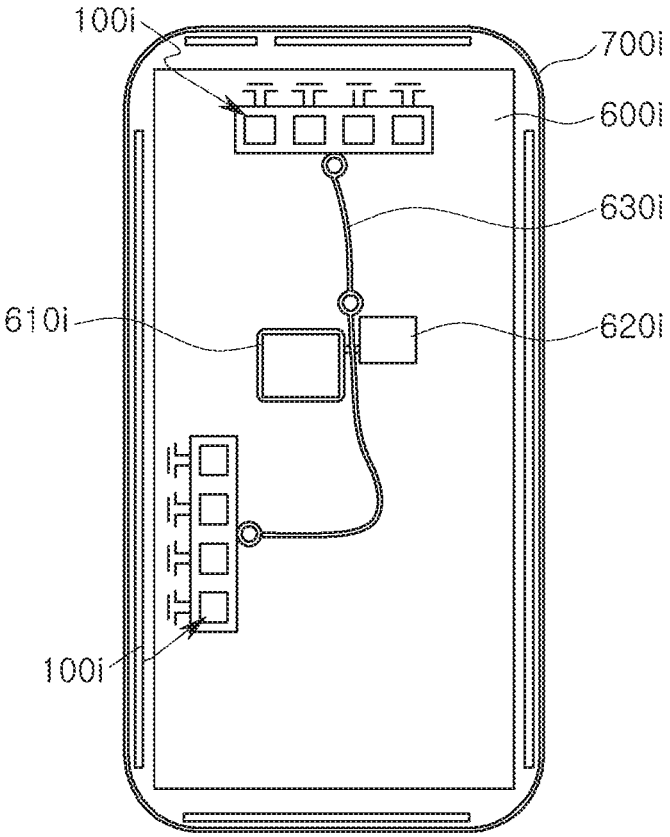

FIGS. 6A and 6B are top views illustrating examples of a placement of an antenna apparatus in an electronic device.

Referring to FIG. 6A, an antenna apparatus including a patch antenna pattern 100*g* is disposed in an inner corner of a case of an electronic device 700*g* on a substrate 600*g* of the electronic device 700*g*.

The electronic device 700*g* may be a smartphone, a personal digital assistant, a digital video camera, a digital still camera, a network system, a computer, a monitor, a tablet, a laptop, a netbook, a television, a video game, a smartwatch, or an automotive component, but is not limited thereto.

A communications module 610*g* and a baseband circuit 620*g* are also disposed on the substrate 600*g*. The antenna apparatus is electrically connected to either one or both of the communications module 610*g* and the baseband circuit 620*g* through a coaxial cable 630*g*.

The communications module 610*g* includes at least some of a memory chip such as a volatile memory (for example, a dynamic random-access memory (DRAM)) or a non-volatile memory (for example, a read-only memory (ROM) or a flash memory; an application processor chip such as a central processor (for example, a central processing unit (CPU)), a graphics processor (for example, a graphics processing unit (GPU)), a digital signal processor, a cryptographic processor, a microprocessor, or a microcontroller; and a logic chip such as an analog-digital converter or an application-specific IC (ASIC).

The baseband circuit 620*g* generates a baseband or IF signal by performing analog-digital conversion, amplification, filtering, and frequency conversion on an analog signal, and generates an analog signal by performing frequency conversion, filtering, amplification, and digital-analog conversion on a baseband or IF signal. The baseband or IF signal is transmitted to or received from the antenna apparatus through the coaxial cable 630*g*.

For example, the baseband or IF signal may be transmitted to or received from an IC of the antenna apparatus, like the IC 310 in FIGS. 4D, 5A, and 5B, through an electrical connection structure, a vias, and circuit and ground patterns. The IC converts the baseband or IF signal into an RF signal in a millimeter wave (mmWave) band to be transmitted, and converts a received RF signal into the baseband or IF signal.

Referring to FIG. 6B, two antenna apparatus each including a patch antenna pattern 100*i* are disposed adjacent to centers of inner sides of a case of a polygonal electronic device 700*i* on a substrate 600*i* of the electronic device 700*i*. A communications module 610*i* and a baseband circuit 620*i* are further disposed on the substrate 600*i*. The antenna apparatuses are electrically connected to either one or both of the communications module 610*i* and the baseband circuit 620*i* by coaxial cables 630*i*.

The dielectric 150 in FIGS. 2B and 3B and the insulating layers of the connection member 200 in FIGS. 5A and 5B may be made of a liquid-crystal polymer (LCP), a low temperature co-fired ceramic (LTCC), a thermosetting resin such as an epoxy resin, or a thermoplastic resin such as a polyimide resin, or a resin such as a thermosetting resin or a thermoplastic resin impregnated together with an inorganic filler into a core material such as glass fiber, glass cloth, or glass fabric, prepregs, Ajinomoto Build-up Film (ABF), FR-4, a bismaleimide triazine (BT) resin, a photoimageable dielectric (PID) resin, a copper-clad laminate (CCL), or a glass- or ceramic-based insulating material.

The various patterns, the vias, the ground planes, the feed lines, and the electrical connection structure disclosed herein may include a metal material (for example, a conductive material such as copper (Cu), aluminum (Al), silver (Ag), tin (Sn), gold (Au), nickel (Ni), lead (Pb), titanium (Ti), or an alloy of any two or more thereof), and may be formed by a plating method such as chemical vapor deposition (CVD), physical vapor deposition (PVD), sputtering, a subtractive process, an additive process, a semi-additive process (SAP), or a modified semi-additive process (mSAP). However, the plating method is not limited thereto.

The RF signals disclosed herein may have a format according to Wi-Fi (IEEE 802.11 family), Worldwide Interoperability for Microwave Access (WiMAX) (IEEE 802.16 family), IEEE 802.20, Long Term Evolution (LTE), Evolution-Data Optimized (EV-DO), Evolved High Speed Packet Access (HSPA+), High Speed Downlink Packet Access (HSDPA), High Speed Uplink Packet Access (HSUPA), Enhanced Data Rates for GSM Evolution (EDGE), Global System for Mobile Communications (GSM), Global Positioning System (GPS), General Packet Radio Service (GPRS), Code-Division Multiple Access (CDMA), Time-Division Multiple Access (TDMA), Digital Enhanced Cordless Telecommunications (DECT), Bluetooth, 3G, 4G, 5G, and any other wireless and wired protocols, but are not limited thereto.

The examples of an antenna apparatus described herein improve antenna performance (for example, a gain, a bandwidth, a directivity, and a transmission and reception rate), or may be easily miniaturized while providing the ability to transmit and receive RF signals in different frequency bands.

In addition, the examples of an antenna apparatus described herein decrease an overall size of the antenna apparatus due to a compact arrangement of patch antenna patterns, reduce a transmission-line energy loss while increasing a degree of freedom of transmission-line impedance matching for different frequency bands, increase a degree of isolation between different frequency bands, improve a gain of each of the different frequency bands, more efficiently radiate a plurality of RF signals having different polarizations.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:

a first patch antenna pattern comprising a through-hole disposed at an offset from a center of the first patch antenna pattern;

a second patch antenna pattern disposed above the first patch antenna pattern and spaced apart from the first patch antenna pattern;

a first feed via electrically connected to the first patch antenna pattern;

a second feed via penetrating through the through-hole of the first patch antenna pattern;

a plurality of shielding vias, electrically connected to the first patch antenna pattern and surrounding the second feed via, configured to improve a gain of each of the first patch antenna pattern and the second patch antenna; and a feed pattern disposed between the first patch antenna pattern and the second patch antenna pattern, and having one end connected to the second feed via, and another end connected to the second patch antenna pattern at a point closer to an edge of the second patch antenna pattern than the second feed via.

2. The antenna apparatus of claim 1, wherein the first feed via is disposed farther from a center of the first patch antenna pattern than the second feed via.

3. The antenna apparatus of claim 1, wherein an electrical connection point of the first patch antenna pattern is biased more than an electrical connection point of the second patch antenna pattern from centers of the first and second patch antenna patterns in a horizontal direction.

4. The antenna apparatus of claim 1, further comprising a coupling patch pattern disposed above the second patch antenna pattern and spaced apart from the second patch antenna pattern.

5. The antenna apparatus of claim 4, wherein a spacing distance between the first patch antenna pattern and the second patch antenna pattern is shorter than a spacing distance between the second patch antenna pattern and the coupling patch pattern.

6. The antenna apparatus of claim 4, wherein the coupling patch pattern comprises a slot.

7. The antenna apparatus of claim 6, wherein the second patch antenna pattern is smaller than the first patch antenna pattern and larger than the coupling patch pattern.

8. The antenna apparatus of claim 6, wherein the second patch antenna pattern has a hole-free shape.

9. The antenna apparatus of claim 1, wherein the shielding vias are offset from a center of the first patch antenna pattern in a first direction, and the antenna apparatus further comprises a plurality of dummy vias electrically connected to the first patch antenna pattern and offset from the center of the first patch antenna pattern in a second direction different from the first direction in which the plurality of shielding vias are offset from the center of the first patch antenna pattern.

10. The antenna apparatus of claim 9, further comprising a ground plane disposed below the first patch antenna pattern, and comprising two through-holes through which the first feed via and the second feed via penetrate, wherein the plurality of shielding vias and the plurality of dummy vias are electrically connected to the ground plane.

11. The antenna apparatus of claim 9, wherein the plurality of dummy vias are disposed to be nearly symmetrical with respect to the plurality of shielding vias relative to the center of the first patch antenna pattern.

12. An antenna apparatus comprising:

a first patch antenna pattern comprising a through-hole disposed at an offset from a center of the first patch antenna pattern;

a second patch antenna pattern disposed above the first patch antenna pattern and spaced apart from the first patch antenna pattern;

a first feed via electrically connected to the first patch antenna pattern;

a second feed via penetrating through the through-hole of the first patch antenna pattern;

a plurality of shielding vias electrically connected to the first patch antenna pattern, surrounding the second feed via, and offset from a center of the first patch antenna pattern in a first direction, wherein the plurality of shielding vias configured to improve a gain of each of the first patch antenna pattern and the second patch antenna; and a plurality of dummy vias electrically connected to the first patch antenna pattern and offset from the center of the first patch antenna pattern in a second direction different from the first direction in which the plurality of shielding vias are offset from the center of the first patch antenna pattern.

13. The antenna apparatus of claim 12, wherein the plurality of dummy vias are disposed to be nearly symmetrical with respect to the plurality of shielding vias relative to the center of the first patch antenna pattern.

14. The antenna apparatus of claim 12, further comprising a ground plane disposed below the first patch antenna pattern, and comprising two through-holes through which the first feed via and the second feed via penetrate, wherein the plurality of shielding vias and the plurality of dummy vias are electrically connected to the ground plane.

15. The antenna apparatus of claim 12, further comprising a coupling patch pattern comprising a slot and disposed above the second patch antenna pattern and spaced apart from the second patch antenna pattern.

16. An antenna apparatus comprising:

a first patch antenna pattern comprising a through-hole disposed at an offset from a center of the first patch antenna pattern;

a second patch antenna pattern disposed above the first patch antenna pattern and spaced apart from the first patch antenna pattern;

a first feed via electrically connected to the first patch antenna pattern;

a second feed via penetrating through the through-hole of the first patch antenna pattern and electrically connected to the second patch antenna pattern; and a plurality of shielding vias, electrically connected to the first patch antenna pattern and surrounding the second feed con figured to improve a gain of each of the first patch antenna pattern and the second patch antenna, wherein a first connection point at which the first feed via is electrically connected to the first patch antenna pattern is farther from a center of the first patch antenna pattern in a first direction than the through-hole is from the center of the first patch antenna pattern in a second direction opposite to the first direction.

17. The antenna apparatus of claim 16, wherein a second connection point at which the second feed via is electrically connected to the second patch antenna pattern is closer to an edge of the second patch antenna pattern in the second direction than the first connection point is to an edge of the first patch antenna pattern in the first direction.

18. The antenna apparatus of claim 17, further comprising:

a feed pattern disposed between the first patch antenna pattern and the second patch antenna pattern; and a third via disposed between the first patch antenna pattern and the second patch antenna pattern, wherein a first end of the feed pattern is connected to the second feed via, a second end of the feed pattern is connected to a first end of the third via, and a second end of the third via is connected to the second patch antenna pattern at the second connection point.

19. The antenna apparatus of claim 16, further comprising:

a plurality of dummy vias electrically connected to the first patch antenna pattern, wherein each of the dummy vias is disposed a first distance from a center of the first patch antenna pattern in the first direction that is equal to a second distance a corresponding one of the shielding vias is disposed from the center of the first patch antenna pattern in the second direction.

20. The antenna apparatus of claim 1, wherein the through-hole of the first patch antenna pattern is closer to the second feed via than the another end connected to the second patch antenna pattern.

* * * * *